United States Patent [19]

Haldemann et al.

[11] Patent Number: 4,521,032

[45] Date of Patent: Jun. 4, 1985

[54] BRAKE DEVICE FOR SKIS

[75] Inventors: Gaston Haldemann, Fürigen; François Wirz, Savièse, both of Switzerland

[73] Assignee: Haldemann A.G., Stans, Switzerland

[21] Appl. No.: 458,910

[22] Filed: Jan. 18, 1983

[30] Foreign Application Priority Data

Jan. 27, 1982 [CH] Switzerland ..... 495/82

[51] Int. Cl.[3] ..... A63C 7/10

[52] U.S. Cl. ..... 280/605

[58] Field of Search ..... 280/605

[56] References Cited

U.S. PATENT DOCUMENTS

| | | | |
|---|---|---|---|
| 4,154,458 | 5/1979 | Wehrli | 280/605 |
| 4,163,569 | 8/1979 | Horn | 280/605 |
| 4,188,043 | 2/1980 | Schwarz | 280/605 |
| 4,227,714 | 10/1980 | Riedel | 280/605 |
| 4,355,817 | 10/1982 | Krob et al. | 280/605 |
| 4,380,345 | 4/1983 | Wittmann | 280/605 |

*Primary Examiner*—Richard A. Bertsch

*Attorney, Agent, or Firm*—Young & Thompson

[57] ABSTRACT

The present invention relates to a brake device for skis which comprises two lateral arms (1, 1') resiliently connected to each other by a spring loop (2) and each bearing as a result of this resilient action against an incline (4, 4') forming an angle with the upper surface of the ski and which has an element (6) secured to the ski. The spring loop connecting the two lateral arms serves as a lever and is adapted to be actuated by the boot to control the movement of the arms between an active position, in which they extend below the sole of the ski (7) and are outwardly directed from the latter, and an inactive position, in which they are retracted substantially parallel and above the lateral edges of the ski.

10 Claims, 13 Drawing Figures

FIG 12
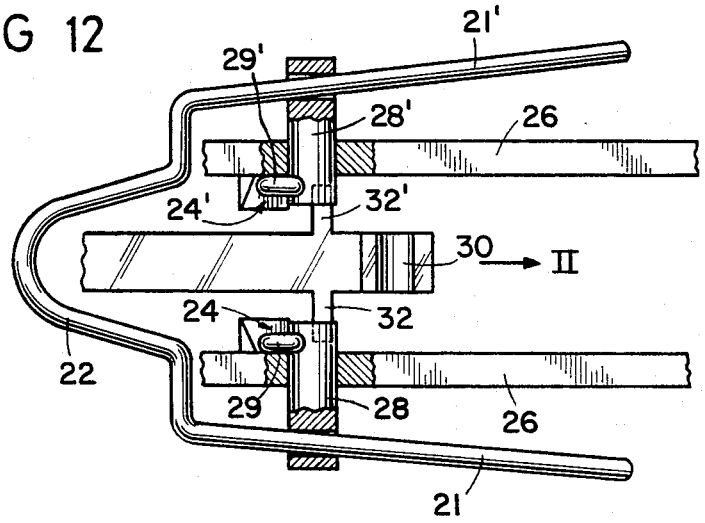
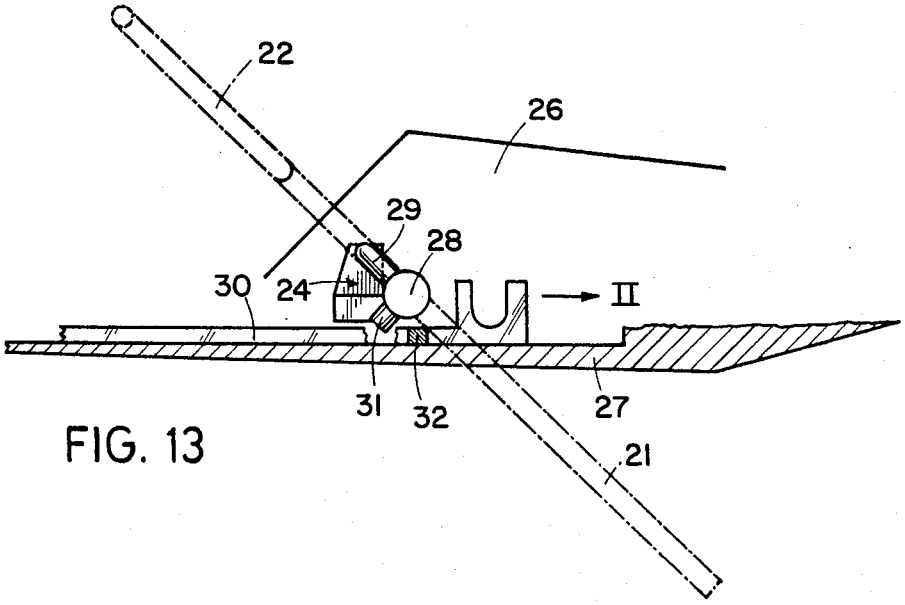
FIG. 13

BRAKE DEVICE FOR SKIS

The present invention relates to a brake device adapted to be provided for a ski to ensure braking and stopping the ski when the latter has been separated from the boot for example as a result of the skier's fall.

Such devices ordinarily called brakes or "stoppers", are already known particularly from Swiss Pat. Nos. 613,122 and 613,626. These known devices comprise a spring member having two lateral arms which are in inactive position parallel to the upper edges of the ski, but outside the latter, while these arms project beneath the ski in the active position when the pressure exerted on a control member by the boot becomes zero. The two principal drawbacks of these brakes are on the one hand the fact that the lateral arms being in inactive position outside the plane of the ski, they impede the movements of the skier and risk tangling the two skis or one ski on the boot of the other ski. On the other hand, the lateral arms having the tendency to draw together toward each other in the active position beneath the sole of the ski, the ability of the brake to dig into the snow is diminished.

As a result, the object of this invention is to provide a brake device for skis which overcomes the above drawbacks. The brake device according to the invention, adapted to achieve this object, is characterized by the fact that it comprises two lateral arms resiliently interconnected to each other in a manner to maintain them spaced apart, each arm, under the influence of this resilient action, bearing against an incline forming an angle with the upper surface of the ski and which has an element fixed to the ski, and by the fact that a forward portion connecting the two lateral arms serves as a lever and is adapted to be actuated by the boot to control the displacement of these arms between an active position in which they project beneath the sole of the ski and are directed exteriorly of the latter, and an inactive position, in which they are retracted substantially parallel to and above the lateral edges of the ski.

The accompanying drawings show schematically and by way of examples several forms of embodiment of the brake device for skis according to the invention.

FIGS. 12 and 13 are respective plan and side views of the third embodiment in active position.

Figure 1:
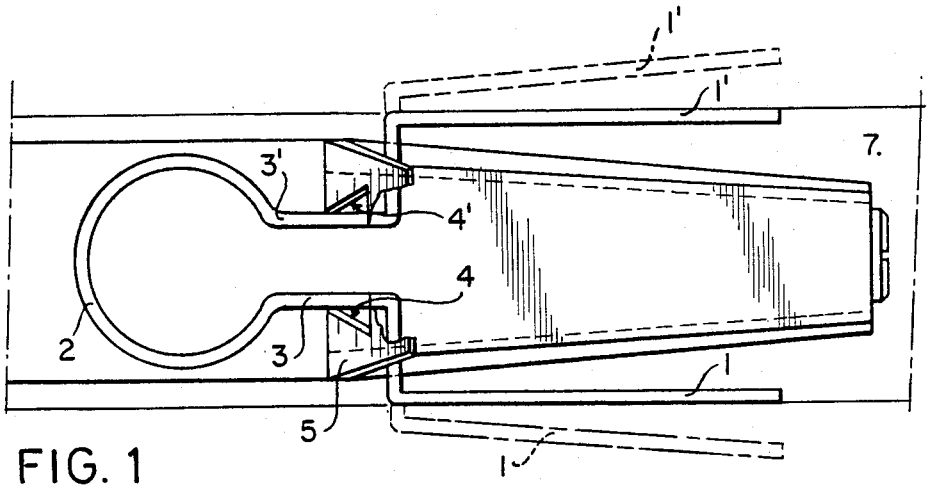
FIGS. 1 and 2 are respective plan and side views of a first embodiment of the invention.
Figure 2:
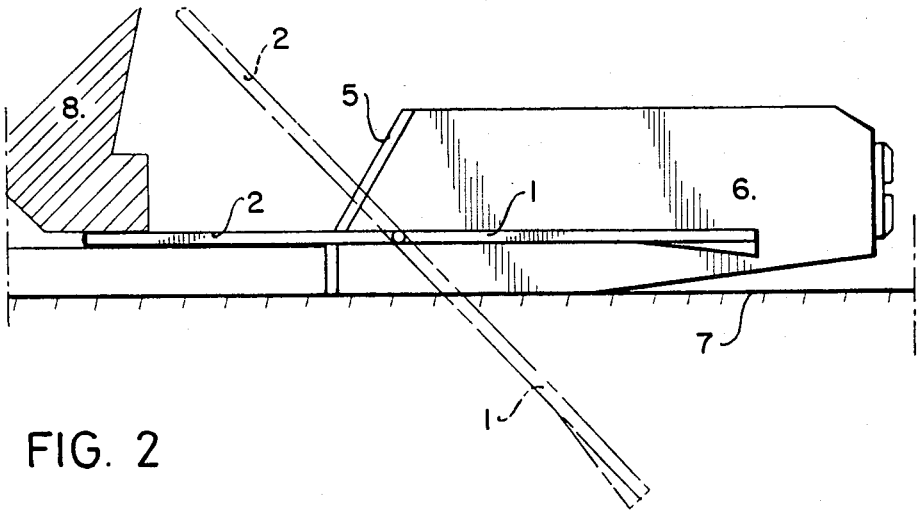
Figure 3:
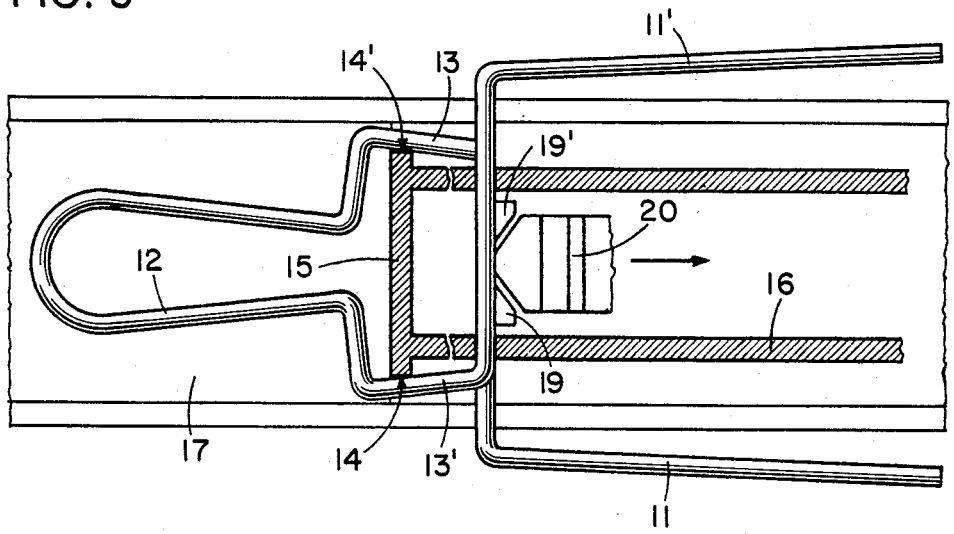
FIGS. 3 to 5 are respective plan, side and front views of a second embodiment of the device in active position.
Figure 4:
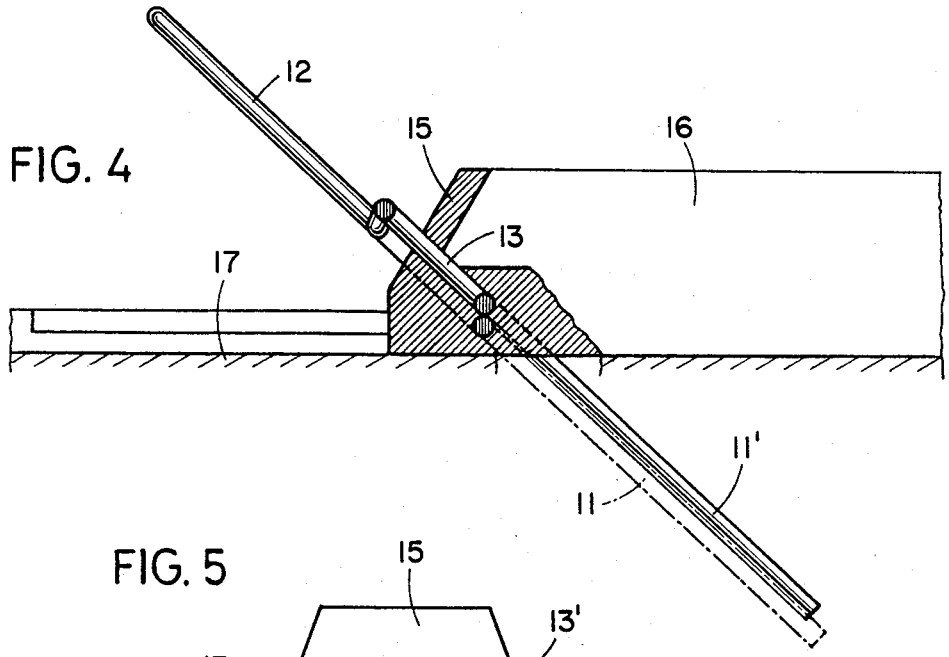
Figure 5:
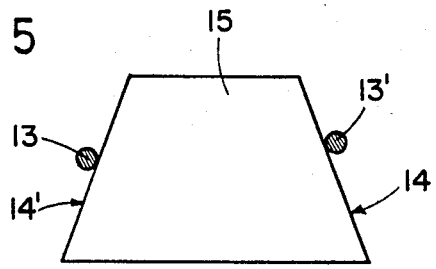

With reference first to FIGS. 1 and 2, a first embodiment of the brake device comprises two lateral arms 1, 1' which are resiliently connected to each other by a spring loop 2, which tends to maintain the arms spaced apart. The intermediate portions 3, 3' disposed between the arms 1, 1' and the spring loop 2 each bear, under the influence of said resilient force, against an incline 4, 4' formed by the edges of an opening provided in the forward wall 5 of a casing 6 secured to ski 7. The inclines 4, 4' therefore form on the one hand an angle with the upper surface of the ski 7 (FIG. 2) and on the other hand are directed upwardly outwardly of the latter.

In the illustrated embodiment, this casing 6 contains the resilient tension member (not shown) of a binding of the type described in companion application Ser. No. 458,908, filed Jan. 18, 1983, with lateral clamps. Of course, the forward wall in which is provided the opening forming the inclines 4, 4' may be that of a classical heel clamp.

The arms 1, 1' are thus displaceable from an inactive position (in full line) in which they are folded substantially horizontally parallel to and above the lateral edges of the ski, and without extending beyond the latter, to an active position (in dashed lines) in which the arms project below the sole of the ski 7 and are slightly outwardly directed, which improves their grip with the snow. The described inactive position is achieved when the boot 8 of the skier is in operative position secured on the ski, the heel of the boot maintaining the spring loop 2 and thus the arms 1, 1' substantially horizontal. When the boot 8 is deliberately or as the result of a fall disengaged from the binding and thus no longer pushes on said spring loop 2, then the spring effect of the latter acts on inclines 4, 4' by means of intermediate portions 3, 3' simultaneously to pivot the arms 1, 1' downwardly and outwardly.

Figure 6:
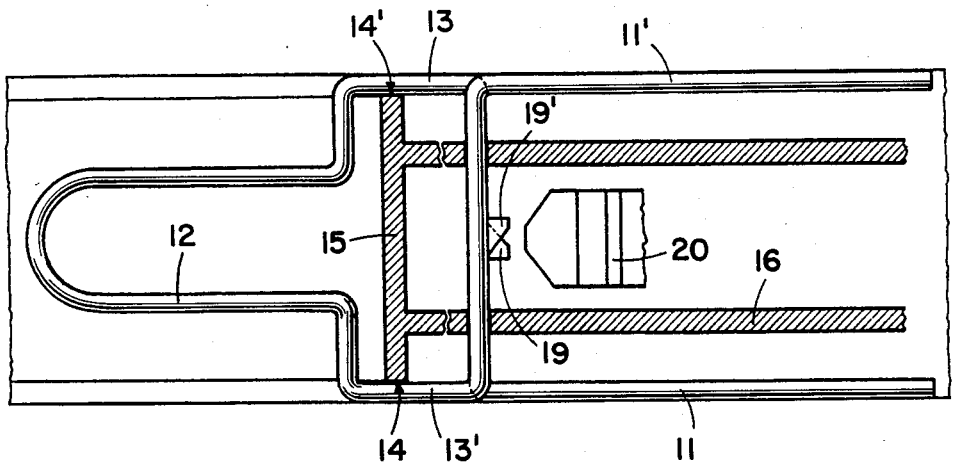
FIGS. 6 to 8 are respective plan, side and front views of the second embodiment in the inactive position.
Figure 7:
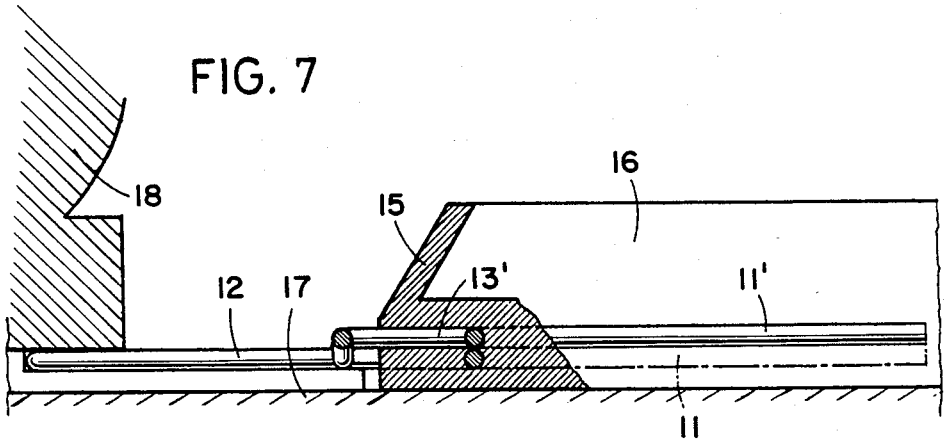
Figure 8:
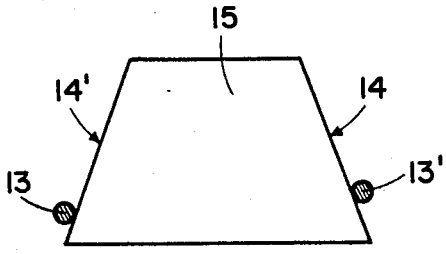
Figure 9:
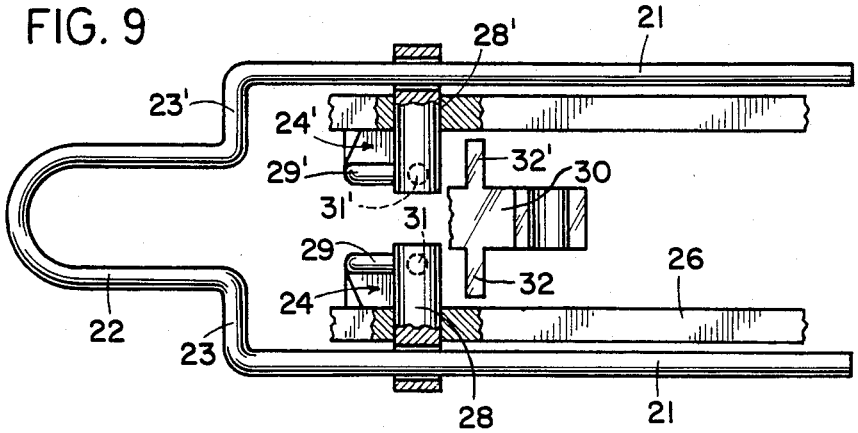
FIGS. 9 and 10 are respective plan and side views of a third embodiment of the device in inactive position.
Figure 10:
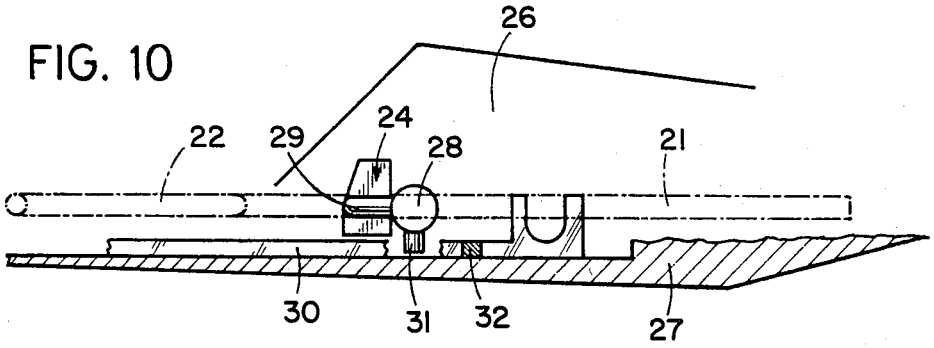
Figure 11:
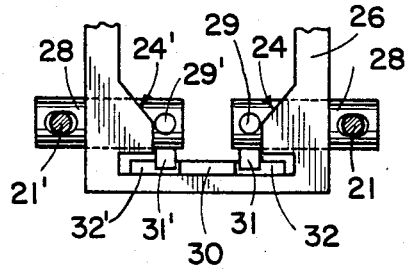
FIG. 11 is a transverse cross-sectional view on the line AA of FIG. 9.

In the second embodiment shown in FIGS. 3 to 8, the brake device also comprises two lateral arms 11, 11' which are resiliently interconnected by a spring loop 12, but differs from the first embodiment by the fact that the portions 13, 13' disposed between the spring loop 12 and the lateral arms 11, 11' cross transversely while passing one above the other. Thus, the inclines 14, 14' on which are articulated the portions 13, 13' of the device form on the one hand an angle with the upper surface of the ski 17 (FIGS. 4 and 7) and on the other hand upwardly converge relative to the latter (FIGS. 5 and 8), thereby to permit movement from the active position of the lateral arms 11, 11' (FIGS. 3 and 4) to the inactive position of the latter (FIGS. 6 and 7). These inclines 14, 14' are here provided by external edges of forward wall 15 of casing 16. As can be seen from FIGS. 5 and 8, the intermediate portions 13, 13' are located near the lower end of inclines 14, 14' in inactive position, and on the upper portion of the latter in the active position. As to the rest, the operation of the brake device is similar to that previously described.

Moreover, the brake device as shown in FIGS. 3 to 8 may also be used as a control means for the automatic donning of the ski ("step-in"). To this end, each intermediate portion 13, 13' disposed between the spring loop 12 and the lateral arms 11, 11' is provided with a lug 19, 19' which is transversely displaced during movement from the active position to the inactive position of the brake device (see FIGS. 3 and 6). The lugs 19, 19' are adapted to enter into contact during passage from the active position (FIG. 3) to the inactive position (FIG. 6) with a portion of the binding device (not shown) of the boot to the ski. In the illustrated embodiment, this member is the rear end 20 of an actuating strip for the lateral clamps of a binding of the type of that described in Swiss patent application No. 495/82. Thus, the relative translatory movement of the two lugs 19, 19' tending to move them toward each other during movement from the active position to the inactive position of the brake device results in longitudinal pressure on the strip 20 in the direction of arrow I (FIG. 3) and therefore in the closure of the binding holding the boot on the ski.

As to the third embodiment shown in FIGS. 9 to 13, it has lateral arms 21, 21' and a spring loop 22 connecting them, similar to those of the first embodiment described in connection with FIGS. 1 and 2. By contrast, in this third embodiment, these lateral arms 21, 21' are maintained on each side by two cylindrical axles 28, 28' transversely slidably mounted in lateral walls of the casing 26. More particularly, the lateral arms 21, 21' extend through the cylindrical axles 28, 28' which have openings therethrough in which said arms may slide with clearance. Moreover, each cylindrical axle 28, 28' is provided with a finger 29, 29' which bears against an incline 24, 24' on the interior of casing 26. Thus, when the spring loop 22 is relieved of the pressure of the boot (not shown), the fingers 29, 29' rise along the inclines 24, 24' under the resilient action of the loop 22 and move the cylindrical axles 28, 28' outwardly, the lateral arms 21, 21' being simultaneously also outwardly moved and pivoted so as to project beneath the sole of the ski 27 (FIGS. 12 and 13).

Finally, as to the second embodiment, the described brake device may also be utilized to unlock the closure system of a binding, for example of the type with lateral clamps, maintaining the boot on the ski. Each transverse cylindrical axle 28, 28' is thus also provided with a control lug 31, 31'. This lug is adapted to push the strip 30 in the direction of the arrow II (FIGS. 12 and 13) during movement from the active position to the inactive position of the brake device, in coaction with the transverse wings 32, 32' which are on the strip 30. As before, the movement of the strip 30 under the action of the control lug 31, 31' is adapted to unlock the closure of the binding device for the boot on the ski.

Preferably, the braking device according to the invention is of one piece, as shown in the accompanying drawings. Of course, it is possible to envisage, within the scope of this invention, embodiments in which the lateral arms are separable from the spring loop tending to maintain them spaced apart.

The embodiments of the invention in which an exclusive property or privilege is claimed are defined as follows:

1. Device for braking skis, characterized by the fact that it comprises two lateral arms resiliently interconnected to each other in a manner to maintain them spaced apart, each arm, under the influence of this resilient action, bearing against an incline forming an angle with the upper surface of the ski and which has an element secured to the ski, and by the fact that a forward portion interconnecting the two lateral arms serves as a lever and is adapted to be actuated by a ski boot to control the movement of these arms between an active position, in which they project beneath the sole of the ski and are outwardly directed from the latter, and an inactive position, in which they are retracted substantially parallel to and above the upper edges of the ski, and a casing containing at least one portion of the binding device of the boot on the ski, said lateral arms being introduced with play each through a cylindrical axle pivotable on itself and transversely slidable in the lateral walls of the casing, each transverse cylindrical axle being provided with a finger coacting with inclines on the casing.

2. Device according to claim 1, characterized by the fact that the forward portion is formed as a spring loop, intended to maintain the arms spaced from each other, an intermediate portion being disposed between said loop and each arm.

3. Device according to claim 2, characterized by the fact that each intermediate portion connects one side of the spring loop with the lateral arm on the same side.

4. Device according to claim 2, characterized by the fact that each intermediate portion connects one side of the spring loop with the lateral arm situated on the other side.

5. Device according to claim 3, characterized by the fact that each intermediate portion bears on an upwardly outwardly extending incline.

6. Device according to claim 4, characterized by the fact that each intermediate portion bears on an upwardly inwardly directed incline.

7. Device according to claim 1, characterized by inclines formed by the edges of an opening provided in the forward wall of the casing.

8. Device according to claim 1, characterized by inclines formed by the external forward edges of the casing.

9. Device according to claim 1, characterized by inclines disposed in the interior of the casing.

10. Device according to claim 1, for skis having a binding for a boot on said ski, characterized by the fact that a movable portion of the device is provided with control means adapted to coact during movement of the brake device from its active position to its inactive position with means of said binding to effect closing of the latter.

* * * * *